US011284684B2

(12) United States Patent
Schaller

(10) Patent No.: US 11,284,684 B2
(45) Date of Patent: Mar. 29, 2022

(54) CLASP FOR A WATCH BRACELET

(71) Applicant: Omega SA, Biel/Bienne (CH)

(72) Inventor: Philippe Schaller, Delemont (CH)

(73) Assignee: Omega SA, Biel/Bienne (CH)

( * ) Notice: Subject to any disclaimer, the term of this patent is extended or adjusted under 35 U.S.C. 154(b) by 107 days.

(21) Appl. No.: 15/930,492

(22) Filed: May 13, 2020

(65) Prior Publication Data

US 2021/0022457 A1 Jan. 28, 2021

(30) Foreign Application Priority Data

Jul. 26, 2019 (EP) ..... 19188669

(51) Int. Cl.
*A44C 5/24* (2006.01)
*A44C 5/02* (2006.01)

(52) U.S. Cl.
CPC ..... *A44C 5/246* (2013.01); *A44C 5/02* (2013.01)

(58) Field of Classification Search
CPC ..... A44C 5/02; A44C 5/246
See application file for complete search history.

(56) References Cited

U.S. PATENT DOCUMENTS 6,119,315 A * 9/2000 Gay ..... A44C 5/24 24/265 WS
6,401,307 B1 * 6/2002 Wild ..... A44C 5/246 24/71 J
6,588,069 B2 * 7/2003 Deriaz ..... A44C 5/24 24/265 WS
6,944,916 B2 * 9/2005 Kawagoe ..... A44C 5/185 24/71 J
7,124,478 B2 * 10/2006 Aquillon ..... A44C 5/2042 24/265 WS
7,571,519 B2 * 8/2009 Sierro ..... A44C 5/185 24/265 WS
8,739,369 B2 * 6/2014 Kaltenrieder ..... A44C 5/24 24/71 J (Continued)

FOREIGN PATENT DOCUMENTS

WO WO 99/02061 A1 1/1999
WO WO 2015/075253 A1 5/2015

OTHER PUBLICATIONS

European Search Report dated Jan. 8, 2020 in European Application 19188669.6 filed on Jul. 26, 2019 (with English Translation of Categories of Cited Documents), 4 pages.

*Primary Examiner* — Jason W San
(74) *Attorney, Agent, or Firm* — Oblon, McClelland, Maier & Neustadt, L.L.P.

(57) ABSTRACT

A clasp for a watch bracelet including a cover connected on a first side to a first bracelet strand and on a second side to a second bracelet strand, a connection between the second bracelet strand and the cover of the clasp, the connection including a connecting link sliding in a longitudinal direction of the clasp between a first position and a second position. The clasp includes at least one first and one second bars mounted in the cover, and the connecting link includes a lever provided with a hook capable of moving from a first position wherein the hook is engaged with a first bar integral with the cover of the clasp, into a second position wherein the hook is released from the engagement thereof with the first bar and the link is free to slide so as to engage the second bar with a hook.

12 Claims, 3 Drawing Sheets

(56) References Cited

U.S. PATENT DOCUMENTS

| | | | | |
|---|---|---|---|---|
| 8,789,245 | B2 * | 7/2014 | Leger | G04B 37/14 24/71 J |
| 8,918,965 | B2 * | 12/2014 | Kaltenrieder | A44C 5/24 24/71 J |
| 9,635,911 | B2 * | 5/2017 | Moille | A44C 5/185 |
| 9,681,711 | B2 * | 6/2017 | Monard | A44C 5/246 |
| 10,470,532 | B2 * | 11/2019 | Mace | A44C 5/24 |
| 10,588,384 | B2 * | 3/2020 | Dos Santos Pedrosa | A44C 5/246 |
| 10,722,006 | B2 * | 7/2020 | Christian | A44C 5/246 |
| 10,820,669 | B2 * | 11/2020 | Chen | A44C 5/14 |
| 10,932,532 | B2 * | 3/2021 | Vuilleme | A44C 5/246 |
| 2005/0262668 | A1 * | 12/2005 | Ho | A44C 5/24 24/71 J |
| 2007/0125123 | A1 * | 6/2007 | Sierro | A44C 5/246 63/3.2 |
| 2008/0083101 | A1 * | 4/2008 | Christian | A44C 5/246 24/71 J |
| 2013/0160255 | A1 * | 6/2013 | Schmidt | A44C 5/14 24/71 J |
| 2014/0223705 | A1 * | 8/2014 | Catanese | A44C 5/246 24/71 J |
| 2021/0022457 | A1 * | 1/2021 | Schaller | A44C 5/246 |

* cited by examiner

CLASP FOR A WATCH BRACELET

CROSS-REFERENCE TO RELATED APPLICATION

This application claims priority to European Patent Application No. 19188669.6 filed on Jul. 26, 2019, the entire disclosure of which is hereby incorporated herein by reference.

FIELD OF THE INVENTION

The present invention relates to a clasp for a bracelet. More specifically, the present invention relates to a clasp for a watch bracelet comprising means of finely adjusting the length of the bracelet.

BACKGROUND OF THE INVENTION

Clasps comprising means of finely adjusting the length of the bracelet of a watch are already known in the prior art. The term "clasp for finely adjusting the length of a bracelet" is understood to mean clasps which allow the length of a bracelet to be adjusted over a short distance to adapt this length as accurately as possible to optimise the comfort of the person wearing the watch. Such clasps usually comprise a connecting link via which one of the bracelet strands is connected to the cover of the clasp. This end link is able to slide in a longitudinal direction of the clasp between a first retracted position wherein it is housed in the cover of the clasp and a second protruding position wherein it is disengaged from the clasp. As a result, the available length for the fine adjustment is determined by the travel of the end link between the first and second positions thereof. The end link cooperates via a toothed element with an undercut in order to index the position of the end link. By way of example, the rack can be integral with the cover of the clasp and the toothed element can be carried by the end link. It is also possible to consider switching the undercut and the toothed element. The European Patent No. 2 765 883 for example discloses a clasp of this type.

When the toothed element is engaged with the undercut, the end link is immobilised. Resilient uncoupling means are provided to disengage the toothed element from the engagement thereof with the undercut. The notching strength between the toothed element and the rack toothing is relatively low, such that the position of the end link can be easily modified, for example by pulling or pushing the end link. Moreover, the handling of such a system does not allow for simple, fast and precise adjustment for the person wearing the watch.

SUMMARY OF THE INVENTION

The purpose of the present invention is to overcome the aforementioned and other drawbacks by providing a clasp for finely adjusting the length of a watch bracelet which, on the one hand, allows the adjustment of the length of the bracelet to be kept without the risk of inadvertently losing same and, on the other hand, provides for particularly simple and fast adjustment and handling.

For this purpose, the present invention relates to a clasp for a watch bracelet comprising a cover connected on a first side to a first bracelet strand and on a second side to a second bracelet strand, connecting means being assembled between the second bracelet strand and the cover of the clasp, these connecting means comprising a connecting link sliding in a longitudinal direction of the clasp between a first position wherein the connecting link is engaged in the cover of the clasp, and a second position wherein the link is at least partially disengaged from the cover of the clasp, characterised in that the clasp comprises at least one first and one second bars mounted in the cover, and in that the connecting link comprises a lever provided with at least one hook designed to move from a first position wherein the at least one hook is engaged with at least one first bar integral with the cover of the clasp, into at least one second position wherein the at least one hook is released from the engagement thereof with said first bar and said link is free to slide so as to engage said second bar with at least one hook.

According to other advantageous alternative embodiments of the invention:

- the lever is arranged such that it pivots relative to the link when moving from the first position into said at least second position;
- the lever is held in the first position by means of a spring housed inside the connecting link;
- said at least one hook and said lever form an element made in one piece;
- the cover comprises at least one third bar defining a third position;
- the connecting link is equipped with a stopping means preventing the connecting link from being removed from the clasp cover;
- the stopping means is formed by a screw which projects into a groove made in the bottom of the cover and which defines two end bankings;
- the cover has an overall U-shaped section and is provided with two wings facing one another, each of these wings bearing an undercut on the inwards-facing face thereof;
- the end link comprises lateral guide surfaces so as to be guided while sliding in the cover between the bottom of the cover and the wings;
- the lever comprises two hooks;
- the connecting link comprises a recess for receiving said spring, said spring bearing at least against the bottom of said recess and said lever.

The invention further relates to a wristwatch equipped with a clasp in accordance with the invention.

BRIEF DESCRIPTION OF THE DRAWINGS

Other features and advantages of the present invention will appear more clearly upon reading the following detailed description of one embodiment of the clasp for a watch bracelet or for a belt according to the invention, this example being provided for the purposes of illustration only and not intended to limit the scope of the invention, given with reference to the accompanying drawing, wherein.

DETAILED DESCRIPTION OF THE PREFERRED EMBODIMENTS

The invention will now be described with reference to a watch bracelet. However, it goes without saying that this example is given for the purposes of illustration only and is non-limiting, and that the clasp according to the invention can also be used for a belt buckle for example.

Figure 1:
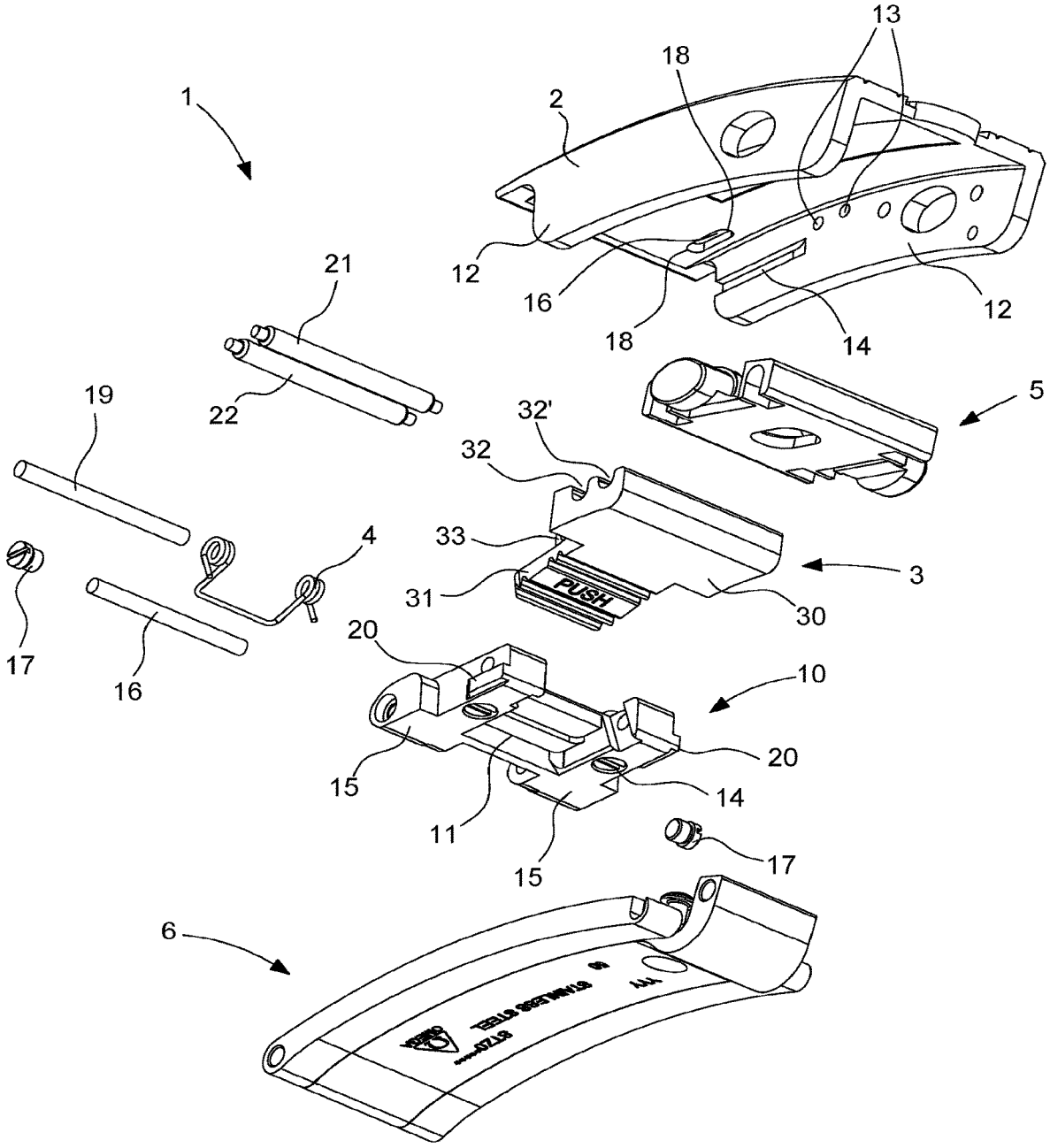
FIG. 1 is an exploded perspective view of the clasp according to the invention.
Figure 2:
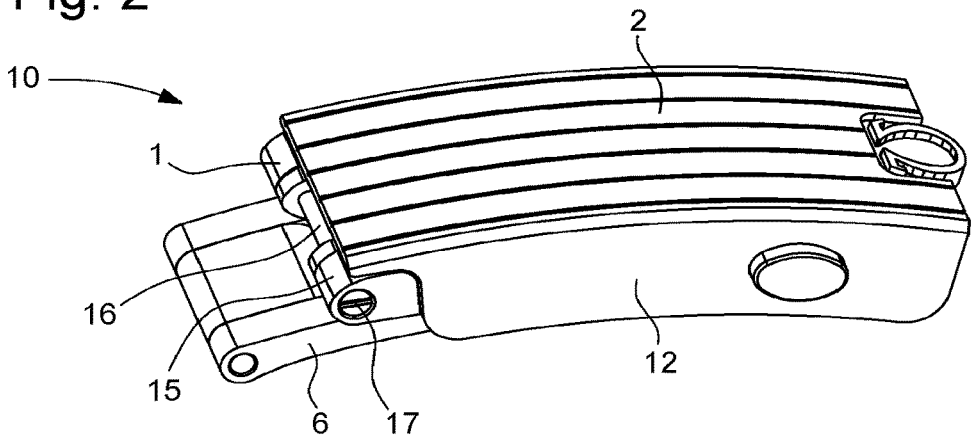
FIG. 2 is a perspective view of the clasp in FIG. 1 in the assembled state.

FIG. 1 is an exploded perspective view of the clasp according to the invention, whereas FIG. 2 is a perspective view of the same clasp in the assembled state. The clasp 1 according to the invention comprises a cover 2, connected on a first side to a first bracelet strand (not shown), with the insertion of a folding-buckle fastening system 6 and clasp locking means, the structures whereof are known and will thus not be described further here. It should be noted that the folding-buckle fastening system 6 can be omitted and that the cover 2 can be directly connected to the first bracelet strand. The cover 2 is connected on a second side to a second bracelet strand (not shown), with a connecting link 10 for the fine adjustment of the length of the bracelet of the watch. The bracelet strands can be formed by a succession of links or by a strand made of leather, fabric or even an elastomer material.

Figure 3:
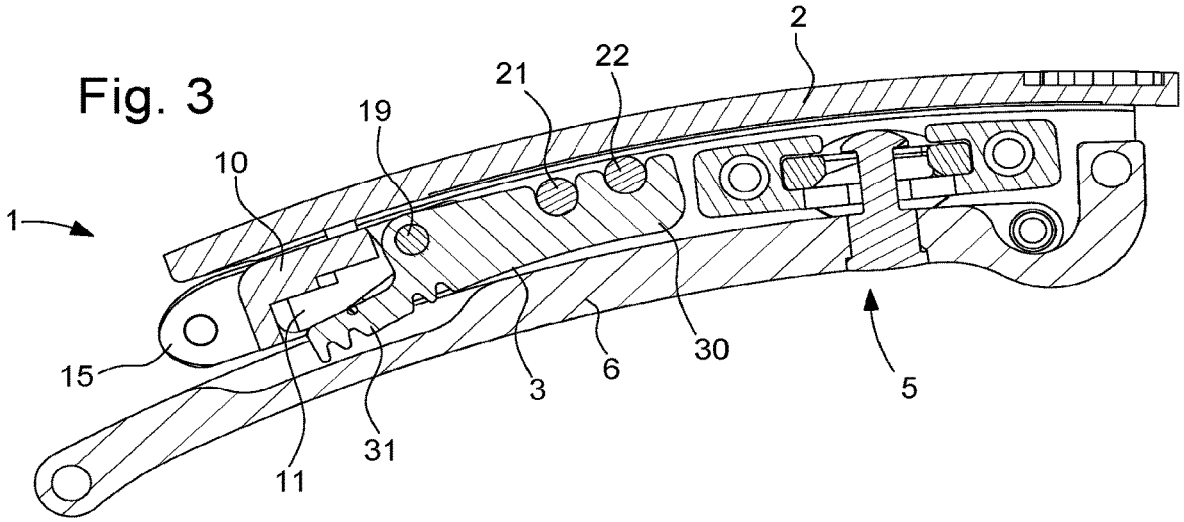
FIG. 3 is a cross-sectional view of the clasp according to the invention with the adjustment link being in the engaged position.
Figure 4:
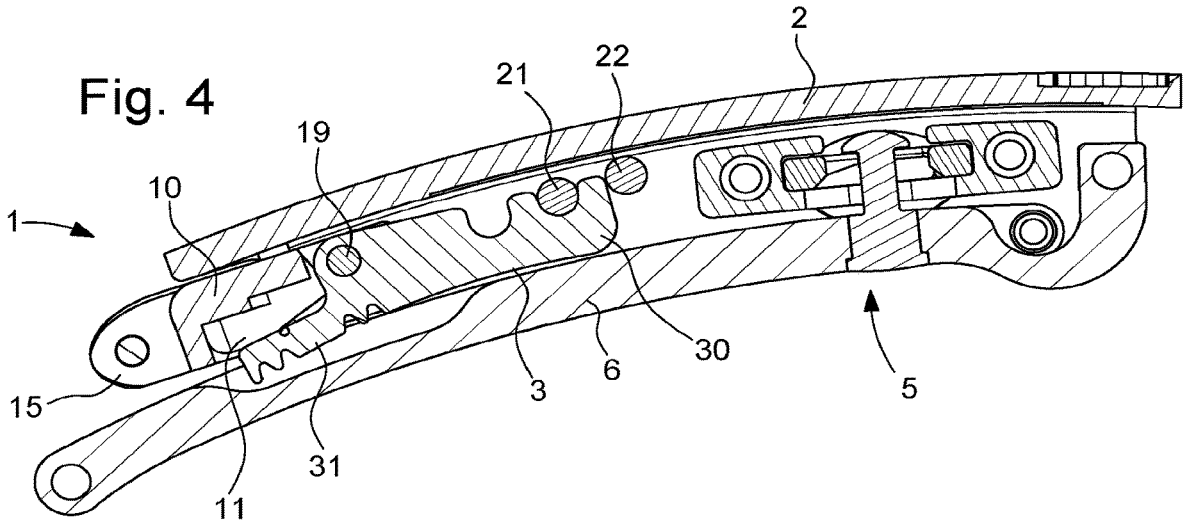
FIG. 4 is a cross-sectional view of the clasp according to the invention with the fine adjustment link being in the disengaged position.

As shown in FIG. 1, the cover 2 has an overall U-shaped section and is provided with two wings 12 facing one another, each of these wings 12 bearing a groove 14 on the inwards-facing face thereof. Moreover, a cavity 16 is made in the bottom of the cover 2 and defines two end bankings 18, the role whereof will be described in detail hereinbelow. Finally, the connecting link 10 comprises lateral guide rails 20 so as to be guided while sliding in the cover 2 between the bottom of the cover 2 and the wings 12. FIGS. 3 and 4 show that the connecting link 10 is capable of sliding in a longitudinal direction of the clasp 1 between a first position (FIG. 3), wherein the connecting link 10 is engaged in the cover 2 of the clasp 1, and a second position (FIG. 4), wherein the connecting link 10 is at least partially disengaged from the cover 2 of the clasp 1. The available length for adjusting the bracelet is determined by the travel of the connecting link 10 between the first and second positions thereof.

The clasp 1 further comprises at least two bars 21, 22 spaced apart from one another and mounted in the cover 2 widthwise as regards the clasp, each end of the bars being designed to rest in a blind orifice 13 machined in the wings 12 of the cover 2, the two bars defining the first and second positions of the link 10. The bars 21, 22 are provided such that they are removable or fixed, and are designed to cooperate with at least one hook 32, 32' so as to lock the connecting link 10 in the first or the second position. Where necessary, a person skilled in the art will not encounter any particular difficulties in adding a third bar and a third hook for example.

The connecting link 10 comprises two ends 15 that are remote from one another, between which one end of a link or of a strand of the second bracelet strand is interlocked. The assembly is ensured by a bar 16 freely moving through the ends 15 and the link/strand of the second bracelet strand, the bar being held by two end screws 17 housed in full or in part inside the connecting link 10.

The connecting link 10 further comprises a lever 3 having a first portion 30 provided with at least two hooks 32, 32', each hook 32, 32' being formed in the first portion of the lever 3 by machining widthwise as regards the clasp 1, each hook having dimensions that are similar to, however slightly greater than, those of the bars 21, 22. A single hook can also be considered, the length whereof thus corresponding to the distance between the first and the last bar, the drawback being that the positioning of the hook on the selected bar is less precise.

In order to limit clearance once the lever 3 has been assembled with the connecting link 10, the width of the first portion of the lever is provided such that it is slightly less than the width of the cover 2. The lever 3 further has a second portion 31, narrower than the first portion 30, acting as a push-piece and at the base whereof a through-hole 33 is provided, having a circular section defining a rotational axis so as to be able to pivot the lever 3 relative to the connecting link 10. The assembly of the lever 3 with the connecting link 10 is ensured by a pin 19 passing through the connecting link 10 and the through-hole 33. Advantageously, the second portion 31 of the lever 3 is slightly directed upwards relative to the link so as to form a positive slope and increase the leverage when the wearer presses this second portion forming the push-piece 30 in a direction perpendicular to the clasp.

The lever 3 is designed to move from a first position wherein at least one hook 32, 32' is engaged with at least one first bar 21, 22 integral with the cover 2, into at least one second position wherein the hook is released from the engagement thereof with the bars.

The connecting link 10 comprises a blind recess 11 that is substantially parallelepipedal in shape, wherein a torsion spring 4 is disposed, this spring 4 being covered by the end of the second portion 31 of the lever 3. It must be understood that when the connecting link 10 and the lever are assembled with one another as shown in FIG. 2, the torsion spring 4, which is mounted such that it is compressed, forces the lever towards the bars 21, 22, such that the hooks 32, 32' are engaged with the bars. Conversely, when the end of the second portion 31 forming the push-piece is pressed in the direction of the arrow A against the elastic return force of the spring 4, the one or more hooks 32, 32' are released from the engagement thereof with the one or more bars of the cover 2 and the link 10 is thus free to slide relative to the cover.

Figure 5:
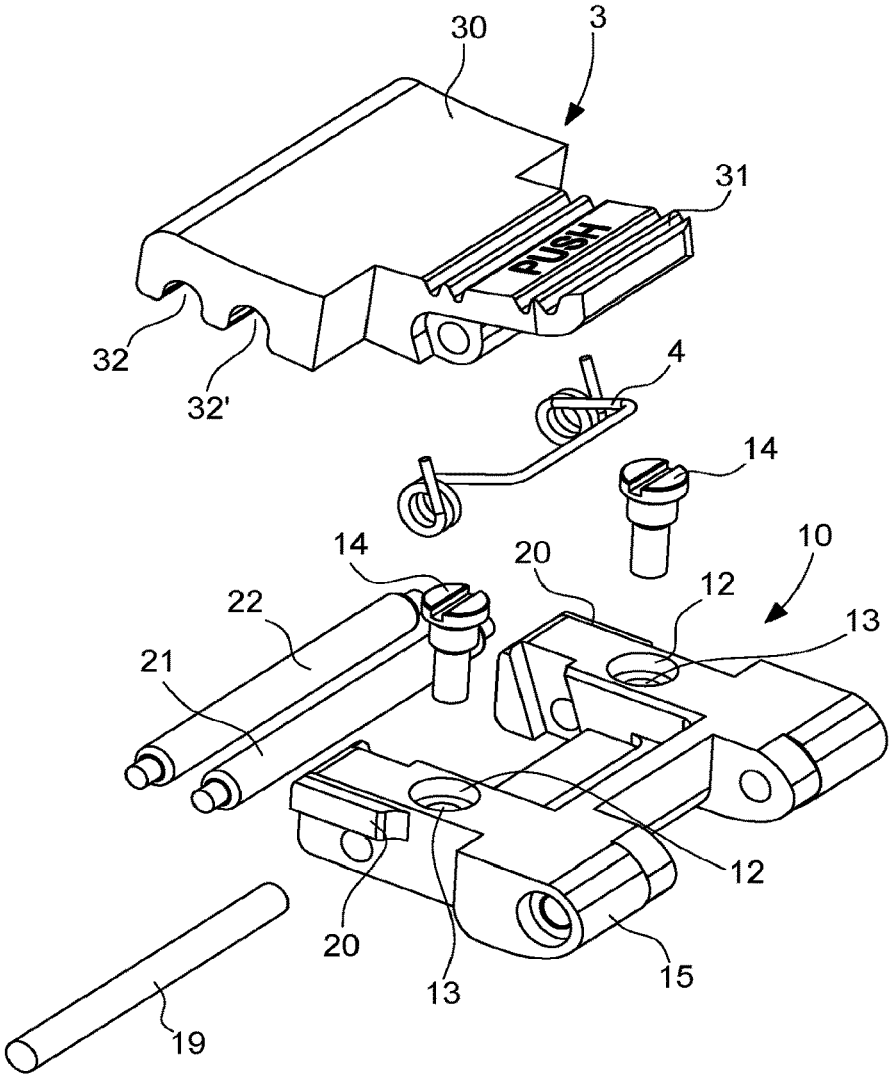
FIG. 5 is a detailed perspective view of the adjustment link of the clasp according to the invention.
Figure 6:
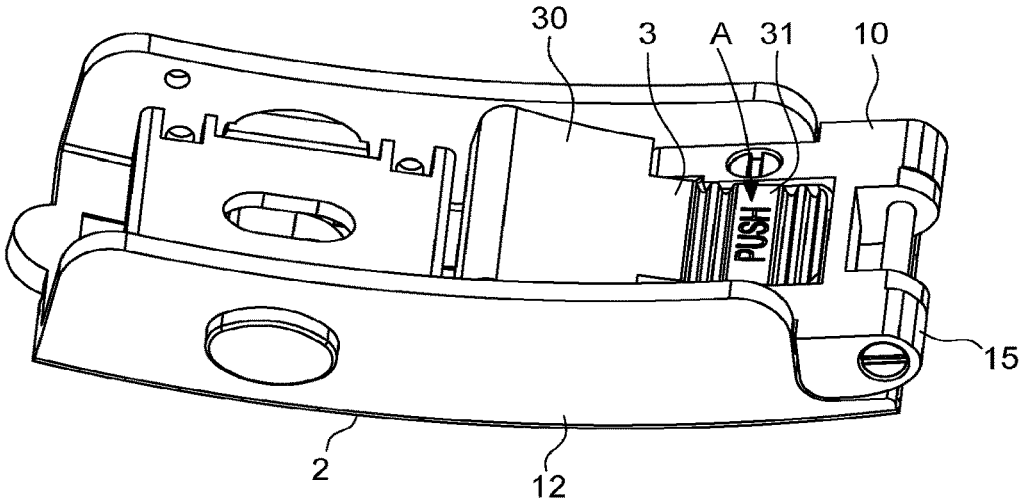
FIG. 6 is a perspective view from below of the clasp according to the invention.

FIG. 5 further shows that, on each side of the parallelepipedal recess 11 made in the connecting link 10, two cylindrical recesses 12 are machined, wherein two threaded through-holes 13 are provided, into which a screw 14 is screwed, the end of the shank whereof projects into the cavity 16 made in the bottom of the cover 2. Since this cavity 16 is made blind at each of the ends thereof by a banking 18 which marks the bottom of the cavity 16, the connecting link 10 cannot be lost once the screws 14 have been screwed into the holes 13. According to one alternative embodiment of the invention, a bush (not shown) is driven into or bonded inside the cylindrical recesses 12 in order to conceal the screw 14 and not leave a hole that is visible to the user.

It goes without saying that the present invention is not limited to the embodiment described above and that various simple alternatives and amendments could be considered by a person skilled in the art without leaving the scope of the invention as defined by the accompanying claims.

In particular, the torsion spring 4 could be replaced by a strip-spring, this strip-spring having a V-shaped profile. It is fastened at the centre thereof by means of a screw in the bottom of the connecting link 10 and the lever 3 elastically bears against the strip-spring. The degree of deflection of the strip-spring determines the travel of the lever and thus of the hooks 32. As a result, the hooks 32 are perfectly notched onto the bars 21, 22 such that the adjustment of the connecting link 10 cannot be accidentally lost.

Thus, in order to adjust the clasp, the user firstly unfolds the clasp 1 in order to access the lever. The user then presses on the portion of the lever forming the push-piece so as to disengage the one or more hooks 32, 32' from the one or more bars 21, 22, thus making the connecting link 10 free to slide, and the wearer can push the latter or pull on the latter to select the adapted bracelet length. Finally, after selecting the length, the wearer releases the push-piece which returns to the rest position thereof under the effect of the spring 4, and at least one of the hooks 32, 32' engages with at least one bar in order to lock the position. The wearer must then simply close the clasp 1 in order to wear the watch.

It goes without saying that the clasp according to the invention can also be used for a garment belt. In such a case, a first end of the belt is directly connected to the cover 2 of the clasp, whereas the second end of the belt is connected to the cover 2 of the clasp with the insertion of the connection means according to the invention, which comprise the connecting link 10.

The invention claimed is:

1. A clasp for a watch bracelet comprising a cover connected on a first side to a first bracelet strand and on a second side to a second bracelet strand, connecting means being assembled between the second bracelet strand and the cover of the clasp, said connecting means comprising a connecting link sliding in a longitudinal direction of the clasp between a first position wherein the connecting link is engaged in the cover of the clasp, and a second position wherein the link is at least partially disengaged from the cover of the clasp, wherein the clasp comprises at least one first and one second bars mounted in the cover, and wherein the connecting link comprises a lever provided with at least one hook designed to move from a first position wherein the at least one hook is engaged with at least one first bar integral with the cover of the clasp, into at least one second position wherein the at least one hook is released from the engagement thereof with said first bar and said link is free to slide so as to engage said second bar with at least one hook.

2. The clasp according to claim 1, wherein the lever is arranged such that it pivots relative to the link when moving from the first position into said at least second position.

3. The clasp according to claim 1, wherein the lever is held in the first position with a spring housed inside the connecting link.

4. The clasp according to claim 1, wherein said at least one hook and said lever form an element made in one piece.

5. The clasp according to claim 1, wherein the cover comprises at least one third bar defining a third position.

6. The clasp according to claim 1, wherein the connecting link is equipped with stopping means for preventing the connecting link from being removed from the cover of the clasp.

7. The clasp according to claim 6, wherein the stopping means is formed by a screw which projects into a groove made in the bottom of the cover and which defines two end bankings.

8. The clasp according to claim 1, wherein the cover has an overall U-shaped section and is provided with two wings facing one another, each of these wings bearing an undercut on the inwards-facing face thereof.

9. The clasp according to claim 8, wherein the connecting link comprises lateral guide surfaces so as to be guided while sliding in the cover between the bottom of the cover and the wings.

10. The clasp according to claim 1, wherein the lever comprises two hooks.

11. The clasp according to claim 1, wherein the connecting link comprises a recess for receiving said spring, said spring bearing at least against the bottom of said recess and said lever.

12. A wristwatch equipped with a clasp according to claim 1.

* * * * *